US005566512A

United States Patent [19]

Page

[11] Patent Number: 5,566,512

[45] Date of Patent: Oct. 22, 1996

[54] INFLATABLE STORAGE CHAMBER

[76] Inventor: George Page, 123 Jersey Street, Ancoats, Manchester M4 9XX, United Kingdom

[21] Appl. No.: 242,239

[22] Filed: May 13, 1994

[51] Int. Cl.[6] ..... E04H 15/22; E04G 11/04

[52] U.S. Cl. ..... 52/2.16; 52/2.11; 52/2.24; 52/DIG. 14

[58] Field of Search ..... 52/DIG. 14, 2.11, 52/2.16, 2.24, 174

[56] References Cited

U.S. PATENT DOCUMENTS

| | | | |
|---|---|---|---|
| 3,474,803 | 10/1969 | Davis . | |
| 4,031,674 | 6/1977 | Rand . | |
| 4,103,369 | 8/1978 | Riordan . | |
| 4,164,329 | 8/1979 | Sadler . | |
| 4,550,533 | 11/1985 | Fraioli . | |
| 4,991,363 | 2/1991 | Ranomae | 52/2.11 |

FOREIGN PATENT DOCUMENTS

| | | | |
|---|---|---|---|
| 2024588 | 1/1980 | United Kingdom . | |
| 2084211 | 4/1982 | United Kingdom . | |
| 2134559 | 8/1984 | United Kingdom . | |
| 2178772 | 2/1987 | United Kingdom . | |
| 2264963 | 9/1993 | United Kingdom | 52/2.11 |
| WO81/00872 | 4/1981 | WIPO . | |
| WO90/12940 | 11/1990 | WIPO . | |

*Primary Examiner*—Carl D. Friedman
*Assistant Examiner*—Yvonne Horton-Richardson
*Attorney, Agent, or Firm*—Fisher, Christen & Sabol

[57] ABSTRACT

An inflatable storage chamber defined by a flexible membrane comprises means for access to the chamber and means for inflating the chamber. The chamber is designed for storing items such as motor vehicles, machinery and furniture.

7 Claims, 4 Drawing Sheets

INFLATABLE STORAGE CHAMBER

FIELD OF THE INVENTION

This invention relates to an inflatable storage chamber.

BACKGROUND OF THE INVENTION

Valuable items such as vintage motor vehicles and antiques will deteriorate if not stored in dry, non-humid conditions. Even if for example a vintage car is stored in a garage the storage conditions are far from perfect. The vehicle will collect dust and grit but even more important is the damage caused by still air and condensation resulting in rusting bodywork and chassis. The interior trim will collect moisture from the still air and will quickly deteriorate. It is known to drape a cover such as a sheet over a car in an attempt to prevent deterioration. However, if a cover remains in contact with the paint work for a substantial length of time then adhesion to the car will tend to occur and on removing the cover some of the paint will become detached from the car.

The present invention has been made from a consideration of these problems.

SUMMARY OF THE INVENTION

According to the present invention, an inflatable chamber adapted for the storage of a motor vehicle has a plastics material base sheet of a generally rectangular shape and of a size not smaller than the vehicle with which the chamber is to be used. The base sheet has four side edges and there is also provided a flexible plastics material upper sheet preformed to be of such a shape that the upper sheet may enclose a motor vehicle located on the base sheet, the upper sheet defining four lower edges corresponding to the four side edges of the base sheet. A clasp fastener, such as a zipper fastener arrangement extends around all four side edges of the base sheet and all four said lower edges of the upper sheet whereby operation of the zipper fastener allows the respective edges of the upper sheet to be joined to those of the lower sheet, to form a substantially sealed chamber, or to be released therefrom to allow access to within the chamber. First and second openings are formed through the upper sheet at opposed positions therein. Around the first opening there is provided electrically air fan means arranged to draw air from the ambient and supply said air drawn through the first opening under pressure to the interior of the chamber thereby to inflate the chamber. An adjustable air vent arrangement is mounted on the upper sheet to overlie the second opening so that the flow of air through the chamber may be controlled by adjustment of the air vent arrangement.

BRIEF DESCRIPTION OF THE DRAWINGS

In order that the invention may be more readily understood a specific embodiment thereof will now be described with reference to the accompanying drawings in which:

FIG. 5(*b*) shows the base of the chamber of FIG. 5(*a*); and

FIG. 5(*c*) is a side view of the chamber of FIG. 5(*a*).

DETAILED DESCRIPTION OF THE INVENTION

Figure 1:
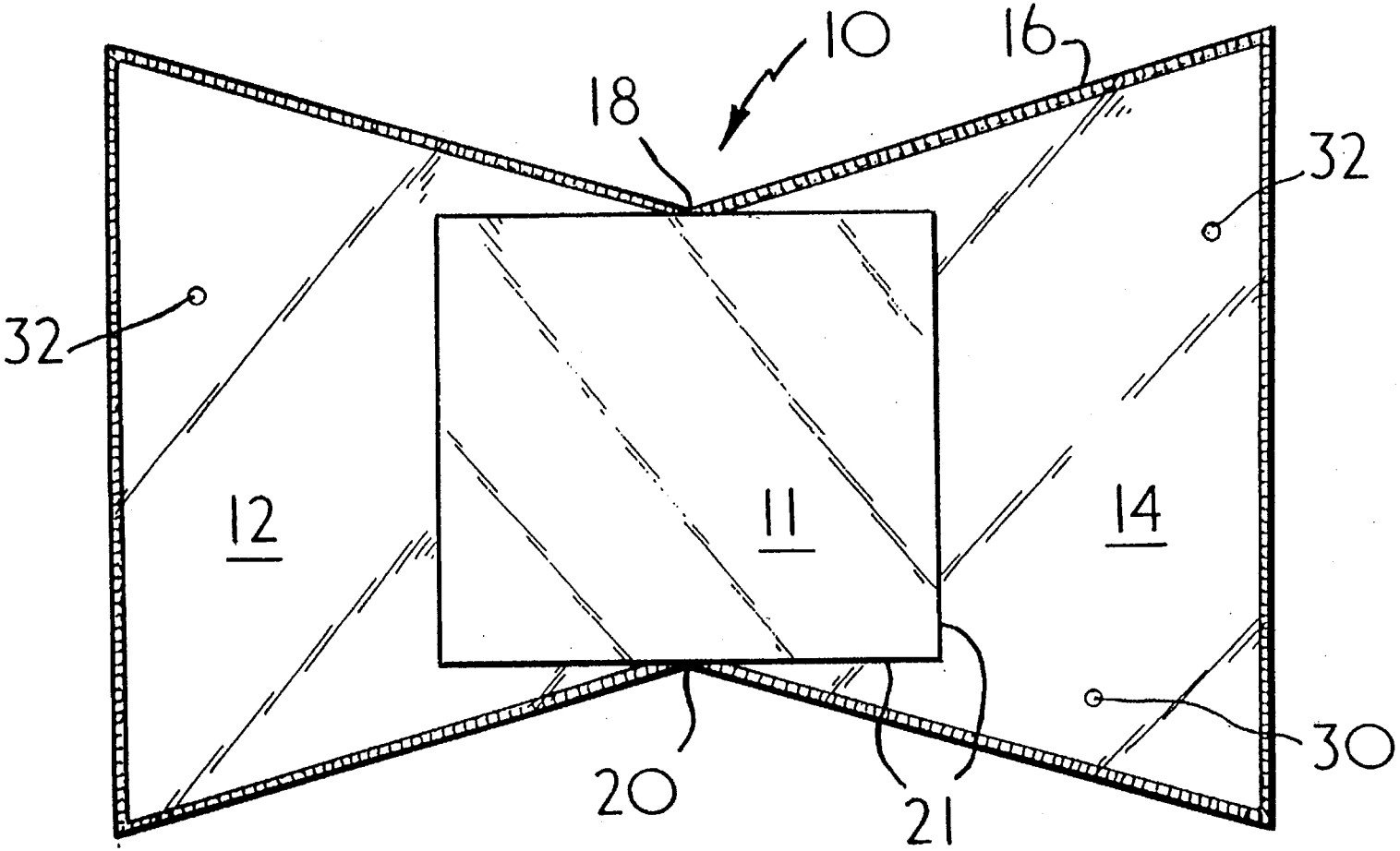
FIG. 1 is a membrane of a first embodiment of the present invention.
Figure 2:
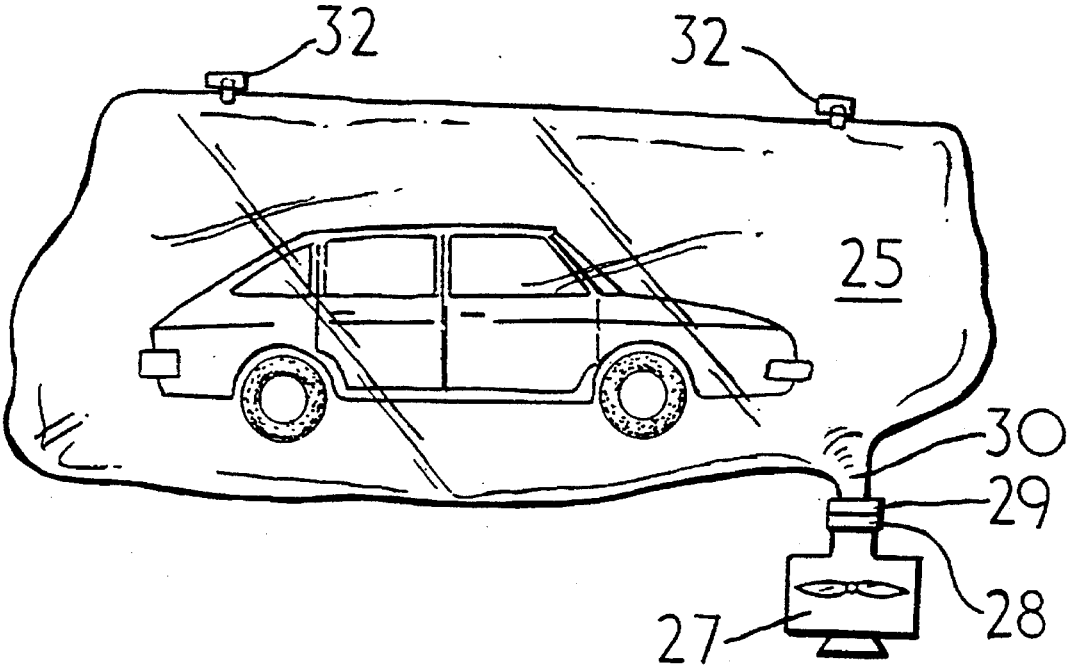
FIG. 2 is an illustrative side elevational view of the inflated chamber of the first embodiment.
Figure 3:
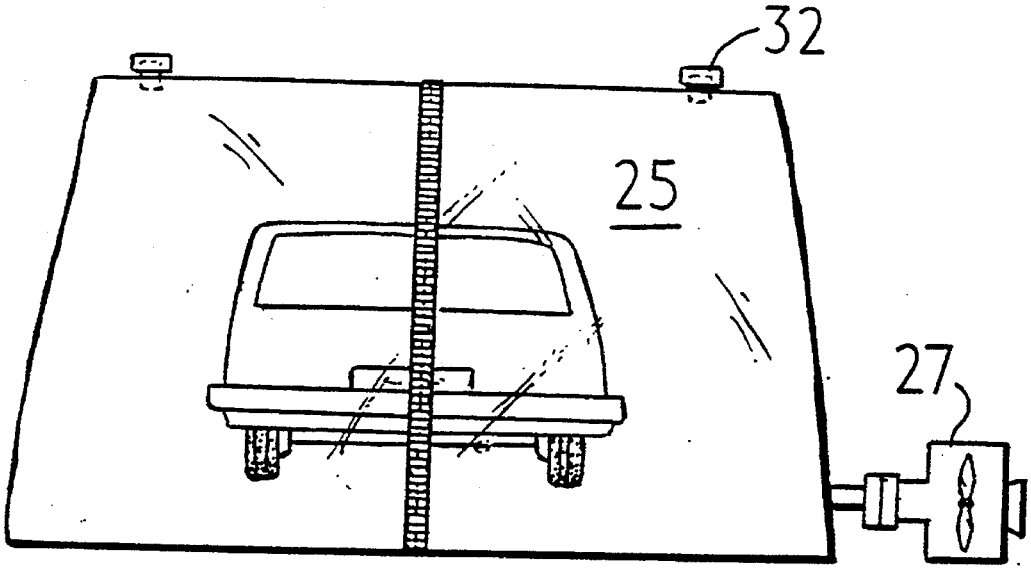
FIG. 3 is a rear view of the inflated chamber of FIG. 2.

According to the present invention there is provided an inflatable storage chamber defined by a flexible membrane comprising a means for access to the chamber and means for inflating the chamber.

In a preferred embodiment of the invention the membrane comprises a plastics sheet which may form a chamber by connecting the edges of the sheet via a clasp fastener.

In another embodiment of the invention the membrane comprises a cover portion and a base portion which may form a chamber by connecting adjacent edges of the cover portion and base portion via a clasp fastener. Three or more adjacent edges of the cover portion and base portion may be connected. The chamber is inflated by a fan motor and safety release valves or vents may be provided in the membrane to prevent over inflation. Any suitable gas or combination of gases may be used such as air, helium or nitrogen. The gas is preferably dried and filtered prior to or upon entering the chamber. A dehumidifier may be provided in or connected to the chamber. The fan motor may be operated via any suitable power source such as battery, mains or solar power. Thus, with the inflatable storage chamber of the present invention items can be stored in a controlled, fresh, dry environment. An individual environment is envisaged for each vehicle.

Referring to the drawings of the first embodiment the two halves 12, 14 of a bow tie shaped plastics sheet 10 may be connected together via a clasp fastener 16 the slide of which is movable between positions 18, 20. Once the two halves 12, 14 are connected the sheet 10 forms a chamber 25. The base 11 of the chamber 25 may optionally be defined by rigid poles 21.

In use an item to be stored within the chamber would be placed on base part 11 while the sheet 10 is in the position shown in FIG. 1. The fastener is subsequently closed to define the chamber 25.

A fan motor 27 is used to draw gas into and thereby inflate the chamber 25 such that only the base of the item or in the case of a motor vehicle the wheels are in contact with the sheet 10.

If air is used to inflate the chamber it is desirable to have a filter 28 and a dehydrating agent 29 such as silica gel provided at the entrance 30 to the chamber 25. These prevent contamination of the environment and maintains dry conditions within the chamber 25. A dehumidifier may be used to maintain dry conditions in addition to, or as an alternative to this.

Air need not be used to inflate the chamber 25. Inert gases such as helium or nitrogen are also suitable.

Safety valves 32 may be provided in the sheet 10 to prevent overinflation of the chamber 25. Filters and dehydrating agents may be provided in the valves 32.

It may be that there will be a slow release of gas from the chamber 25. If this is so then the amount of gas within the chamber 25 will need to be maintained within certain parameters. This can be achieved by using a pressure meter (not shown) which is connected to the motor 27 and automatically switches on the motor 27 when the amount of gas in the chamber has fallen below a certain minimum level and switches the motor 27 off as the amount of gas in the chamber 25 reaches a predefined maximum level.

The sheet 10 may be made of any suitable flexible plastics material such as polypropylene, but the plastics material is preferably transparent to allow the stored item to be viewed from outside the chamber. Alternatively, windows of transparent plastics material may be provided.

Figures 4, 4A:
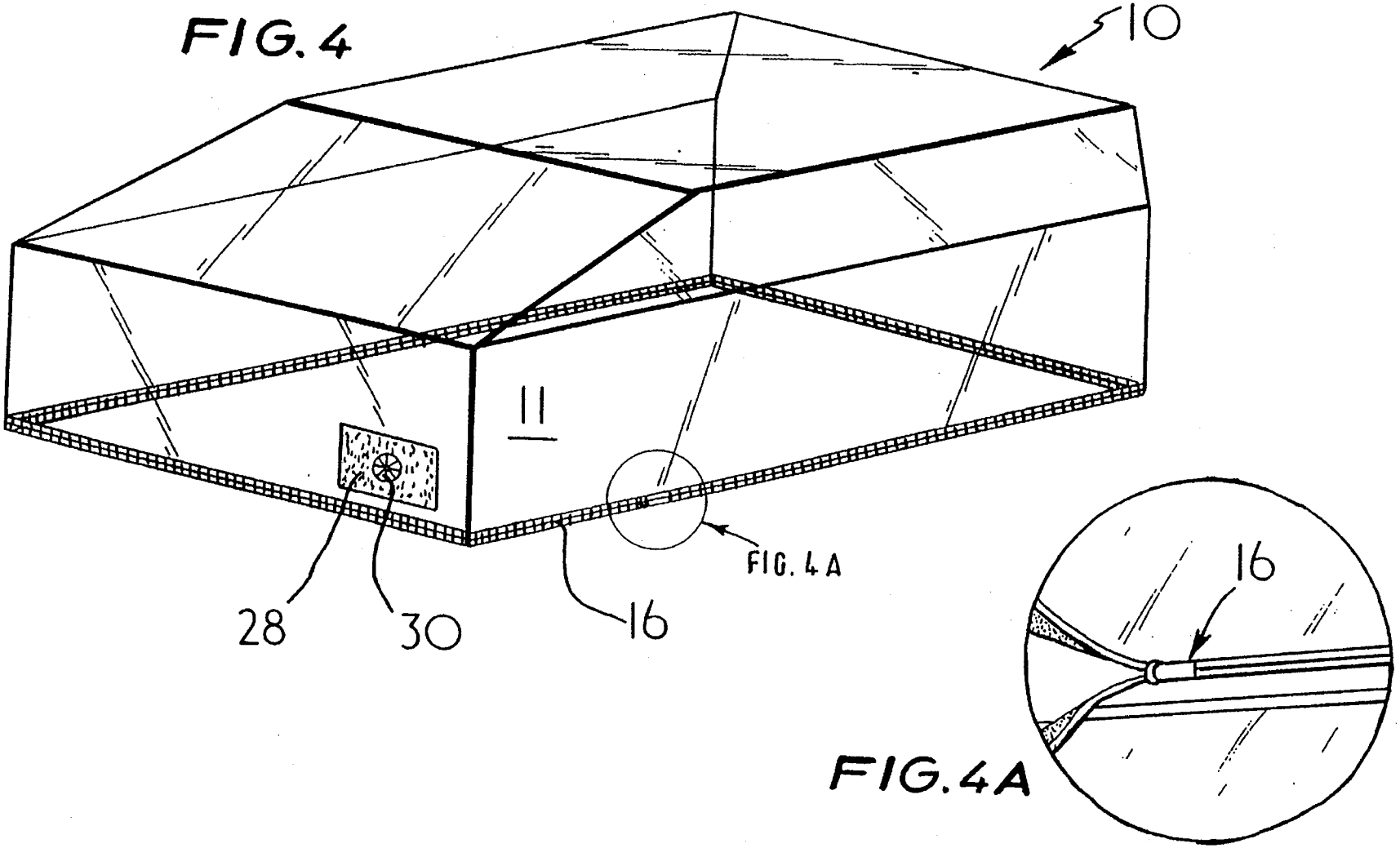
FIG. 4 is a perspective view of the inflated chamber of a second embodiment of the present invention.

FIG. 4 shows a second embodiment of the present invention which is similar to the first embodiment and like reference numerals are used to represent like features. In this embodiment, the clasp fastener 16 is a plastic zip which extends around three sides of the chamber, adjacent the base.

Figure 5A:
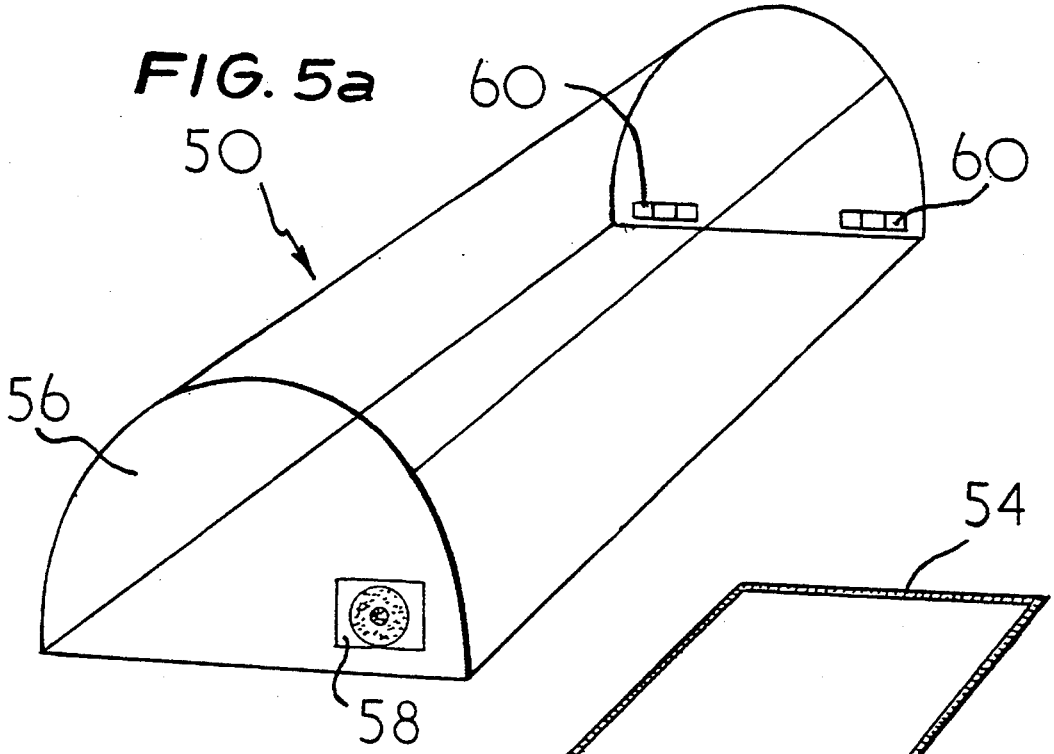
FIG. 5(*a*) is a perspective view of the inflated chamber of a third embodiment of the present invention.
Figure 5B:
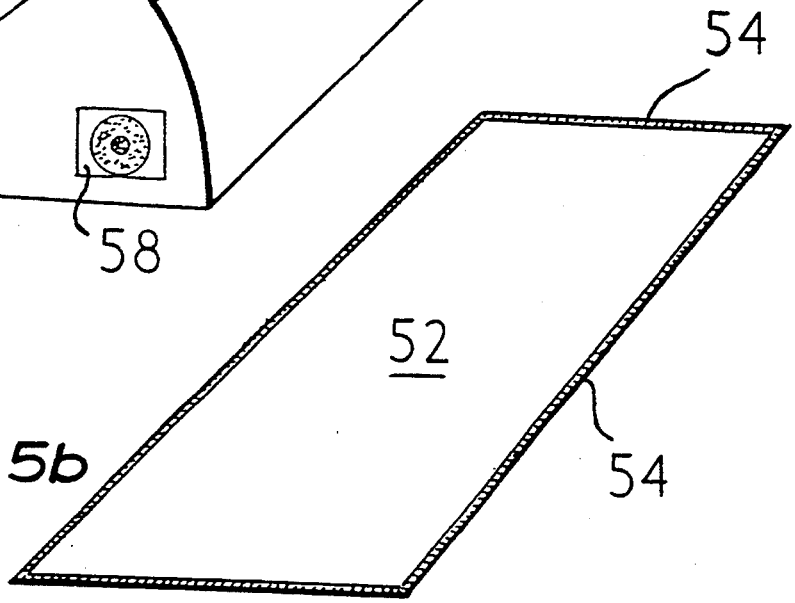
Figure 5C:
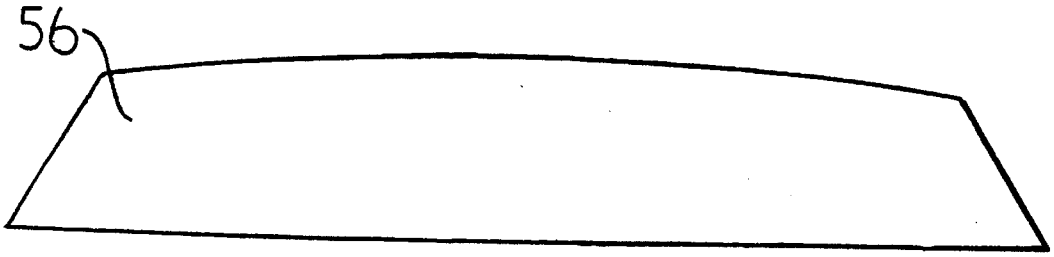

Referring to the third embodiment shown in FIG. 5, the inflatable chamber 50 is formed by starting with a base sheet 52 of coloured pvc with a zip 54 around all four sides. A clear pvc top 56 is attached and zipped to the base forming a sealed unit. To this sealed unit a small fan and air filter unit 58 is added which not only inflates the chamber but supplies a constant flow of fresh filtered air through the entire unit. The unit 58 is sewn into the top cover 56. To stimulate and enhance the flow of air throughout the unit controlled openings 60 are provided in the top 56 in one end panel, adjacent the base part. These adjustable vents are set into the unit at opposite ends to the fan and filter assembly, thus ensuring air blown into the chamber passes over and through the entire contents of the chamber. The fan and filter will supply enough dust free air to change the air inside the chamber 3 times every hour. This flow of constantly changing fresh air will have the effect of drying whatever is stored in the unit, i.e if a wet motor car were placed in the unit, it would completely dry (after several hours) and stay that way as long as stored. The openings 60 may be plastic, adjustable air vents.

In use, the vehicle or object to be stored is placed on the base 52 and the clear top cover is then thrown over it. The cover and base are then joined together around all four sides by means of the zip 54. The fan is turned on to inflate the chamber. Usually such inflation will be achieved in approximately ten minutes. The rear air vents are then adjusted to control the chamber ventilation.

The chamber may be designed to approximate the shape of a motor vehicle, as illustrated.

The top cover may be 500s gauge clear plastic and the base sheet may be 1000s gauge clear plastic.

The present invention therefore provides an inflatable chamber which can store an item in a suitable environment whilst only the base of the item is in contact with the chamber and the item can be viewed from outside the chamber.

It is to be understood that the above described embodiments are by way of example only and many modifications and variations may be made.

The size of the chamber may be adapted to suit the item to be stored. Supplementary rigid supports may be attached to the sheet to ensure that once inflated the chamber has a set configuration.

Any item may be stored within the chamber such as motor vehicles, machinery, furniture especially vintage cars and antiques.

I claim:

1. An inflatable chamber adapted for the storage of a motor vehicle, which chamber comprises:

a plastics material base sheet of generally rectangular shape and of a size not smaller than the vehicle with which the chamber is to be used, the base sheet having four side edges;

a flexible plastics material upper sheet preformed to be of such a shape that the upper sheet may enclose a motor vehicle located on the base sheet, the upper sheet defining four lower edges corresponding to the side edges of the base sheet;

zipper fastener means extending around all four said side edges of the base sheet and all four said lower edges of the upper sheet whereby operation of the zipper fastener means of the base sheet and the upper sheet joins together the base sheet and the upper sheet to form a substantially sealed chamber;

first and second openings formed through the upper sheet at opposed positions therein;

electrically driven air fan means mounted on the upper sheet around the first opening and arranged to draw air from the ambient and supply said drawn air through said first opening under pressure to the interior of the chamber thereby to inflate the chamber; and adjustable air vent means mounted on said upper sheet to overlie said second opening whereby the flow of air through the chamber may be controlled by adjustment of said air vent means.

2. An inflatable storage chamber according to claim 1, wherein the air fan means draws air from the ambient and supplies said drawn air through the chamber at such a rate that the air within the chamber is changed about three times every hour.

3. An inflatable storage chamber according to claim 1, wherein a dehumidifier is provided in the chamber.

4. An inflatable storage chamber according to claim 1, wherein a dehumidifier is provided within said first opening whereby air supplied under pressure by the air fan means passes through the dehumidifier.

5. An inflatable storage chamber according to claim 1, wherein the base sheet comprises a clear plastics material of approximately 1000 gauge.

6. An inflatable storage chamber according to claim 1, wherein the upper sheet comprises a clear plastics material of approximately 500 gauge.

7. An inflatable storage chamber according to claim 1, wherein the shape of the chamber as defined by the base sheet and the upper sheet, when inflated, approximates to that of a motor vehicle whereby said motor vehicle may be stored therewithin.

* * * * *